United States Patent [19]

Tippie et al.

[11] Patent Number: 4,584,431

[45] Date of Patent: Apr. 22, 1986

[54] HIGH VOLTAGE RF COAXIAL CABLE

[76] Inventors: Robert J. Tippie, 375 Fleagle Rd., Glen Burnie, Md. 21061; Anthony T. Nasuta, Jr., 5 Hollis Ct., Timonium, Md. 21093

[21] Appl. No.: 659,920

[22] Filed: Oct. 11, 1984

[51] Int. Cl.[4] ..... H01B 11/18

[52] U.S. Cl. ..... 174/107; 156/56; 156/149; 174/102 SC; 174/110 S; 174/120 SC; 174/120 AR; 428/377; 428/391

[58] Field of Search ..... 174/107, 109, 102 SC, 174/105 SC, 106 SC, 110 S, 110 AR, 120 SC, 120 AR, 127; 156/56, 149; 428/377, 391

[56] References Cited

U.S. PATENT DOCUMENTS

| | | | |
|---|---|---|---|
| 2,379,942 | 7/1945 | Webber | 173/328 |
| 3,098,893 | 7/1963 | Pringle et al. | 174/102 |
| 3,187,071 | 6/1965 | Radziejowski | 174/102 SC |
| 3,192,309 | 6/1965 | Zoder et al. | 156/56 X |
| 3,236,939 | 2/1966 | Blewis et al. | 174/110 AR |
| 3,259,688 | 7/1966 | Towne et al. | 174/107 |
| 3,433,687 | 3/1969 | Price | 174/102 SC |
| 3,643,004 | 2/1972 | McKean | 174/36 |
| 3,660,592 | 5/1972 | Anderson | 174/114 R |
| 3,735,025 | 5/1973 | Ling et al. | 174/120 SC |
| 3,792,409 | 2/1974 | Smart et al. | 174/105 SC X |
| 4,341,578 | 7/1982 | Chermak et al. | 156/149 |
| 4,456,785 | 6/1984 | Kushner et al. | 174/105 SC |

*Primary Examiner*—A. T. Grimley
*Assistant Examiner*—Morris H. Nimmo
*Attorney, Agent, or Firm*—Donald J. Singer; Richard J. Donahue

[57] ABSTRACT

A high voltage coaxial cable wherein a corona-free configuration is produced by applying a room temperature-curable silicone elastomeric material under pressure to the outer surface of the cable braid so that the material is forced between the voids of the braid and adheres to the primary insulation material at the insulation/braid interface.

8 Claims, 1 Drawing Figure

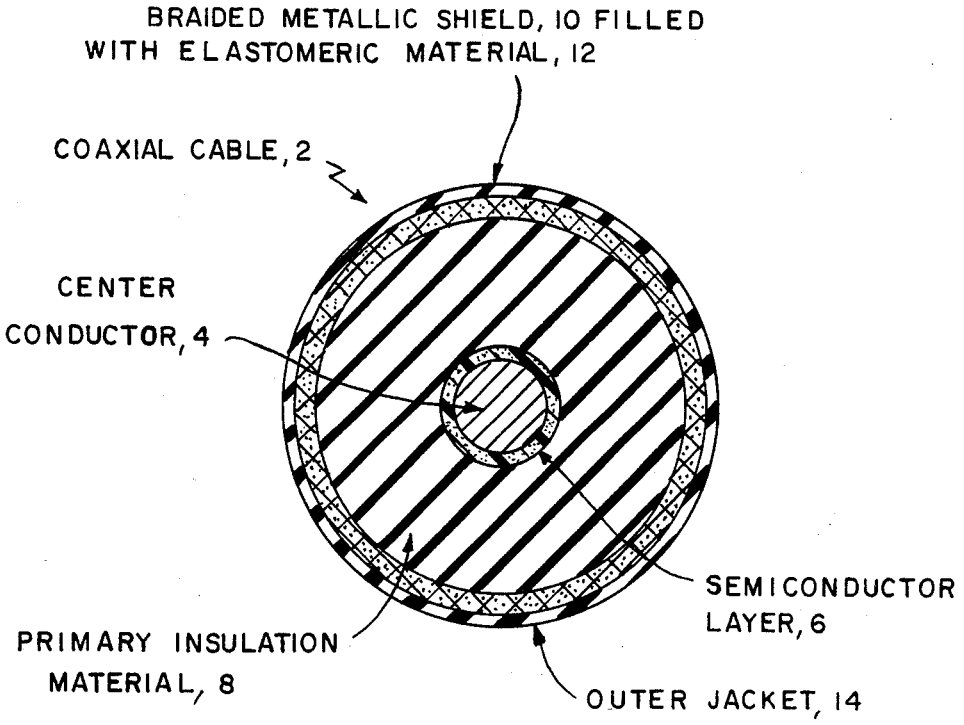
BRAIDED METALLIC SHIELD, 10 FILLED WITH ELASTOMERIC MATERIAL, 12
COAXIAL CABLE, 2
CENTER CONDUCTOR, 4
SEMICONDUCTOR LAYER, 6
PRIMARY INSULATION MATERIAL, 8
OUTER JACKET, 14

HIGH VOLTAGE RF COAXIAL CABLE

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to a coaxial cable particularly suited for use in high voltage RF applications.

A need exists for an improved coaxial cable for interconnecting a transmitter which generates high frequency RF power (in the order of 100 KW at peak RF voltages approximating 40 KV) to a suitable antenna or to a dummy load. Such a coaxial cable is susceptible to a corona discharge at the interface of the center conductor and the surrounding primary insulation material. A corona discharge can also occur between the primary insulation material and the braided outer conductor or shield of the coaxial cable, resulting in the loss of power and excessive heating of the cable at higher frequencies of operation.

Such corona discharges result mainly from the ionization of air in voids or cavities which exist between the primary insulation material at its interfaces with the center conductor and with the braided outer shield. The elimination of corona discharge in any high voltage cable therefore requires that either the voltage stress be controlled to a level below corona onset, or the elimination of air at each high voltage interface. Since in high voltage applications, the cable size would generally be too large if the voltage stresses were kept below corona onset, most high voltage coaxial cables are designed using the latter approach.

One technique presently used in the design of high voltage coaxial cable involves the extrusion of a semiconductor material over the center conductor such that gaps are not formed therebetween. The semiconductor material and the insulation material are generally coextruded onto the center conductor and after curing, there should be no gaps at their interface.

When a high voltage is applied to the center conductor, the semiconductor material, which is in electrical contact with the center conductor, is also at the same voltage. Since there is no potential difference between the center conductor and the semiconductor material, any air that might be trapped at that interface is not stressed. The high voltage interface between the semiconductor material and its surrounding primary insulation material, is also a substantially air-free interface and the stresses can be higher without creating corona discharge. As previously mentioned, this technique is utilized in many high voltage cables.

When the voltage applied to a coaxial cable is high enough, corona can also exist at the outer boundary of the primary insulation material and the braided metallic shield formed over the primary insulation material, due to the entrapment of air therebetween. One presently known method of eliminating the air at the primary insulation/outer braid interface is to either extrude a second semiconductor layer over the primary insulation or to paint on a carbon filled ink and wrap over the ink a layer of carbon filled fabric tape. The same principle as described earlier applies here, in that the semiconductor layer and braided shield are now at the same voltage and any air at that boundary is not stressed.

Another method of avoiding corona discharge in electrical cable is mentioned in U.S. Pat. No. 3,259,688 issued to Allen N. Towne et al on July 5, 1966. It is mentioned therein that tapes formed of elastomeric material or impregnated with semiconductive materials such as graphite, carbon black, and the like may produce voids at points of overlapping, fostering the production of corona and defeating the purpose of the electrically conductive grading material.

Towne et al therefore propose the use of a composite insulation comprising a first taped or sheet layer of semiconducting material comprising copolymers of polyethylene and mono-unsaturated materials along with a ground insulation of extruded polyethylene. Another layer of polyethylene copolymer material may surround the primary insulation over which a metallic shield is wrapped.

While the aforementioned solutions to the corona problem at the center conductor/primary insulator interface are generally acceptable, the requirement for a second such extruded semiconductor layer or impregnated tape layer at the primary insulation/outer shield interface results in a coaxial cable that is much more difficult and expensive to manufacture, requiring tightly controlled manufacturing processes. Furthermore, the quality over life of the cable will be greatly reduced and the cable will be limited to use in environments which do not have low temperatures and applications which do not require high vibration or flexure of the cable.

OBJECTS AND SUMMARY OF THE INVENTION

It is therefore the primary object of the present invention to provide a high voltage RF coaxial cable which is relatively immune to corona discharge and which is not subject to the above-noted disadvantages of presently known coaxial cables.

A high voltage coaxial cable is disclosed which eliminates the need for any semiconducting materials immediately under the braided shield. Corona discharge is prevented by applying a room temperature curable silicone material at the insulation/braid interface thus eliminating air at this interface.

The aforementioned object and advantages of the invention will become more apparent upon reference to the following specification, attendant claims and drawing.

BRIEF DESCRIPTION OF THE DRAWING

The sole FIGURE of the drawing is a cross-sectional view of the coaxial cable of the present invention.

DETAILED DESCRIPTION OF THE INVENTION

Referring now to the drawing, the high voltage coaxial cable 2 of the present invention comprises a center conductor 4, which may be a single solid conductor or a plurality of strands of wire. Immediately surrounding the center conductor 4 is a layer of semiconductor material 6, which, as described earlier, may either be extruded thereon or may consist of particles of semiconductor material, such as carbon, which are embedded in a tape which is wrapped around center conductor 4. Surrounding semiconductor layer 6 is the primary insulation material 8, which may be extruded over the semiconductor layer 6. A braided metallic shield 10 is woven about primary insulation material 8.

Instead of providing a second semiconductor layer between the outer surface of the primary insulation material 8 and the braided metallic shield 10 to minimize corona problems, as is known in the art, the present invention eliminates the need for such a second layer by impregnating the braided shield 10 with a room temperature vulcanizing or curable elastomeric material 12 such as the product RTV102 marketed by the General Electric Company.

Thus, the invention described above combines the use of existing materials and components in a unique way so to create a high voltage RF coaxial cable assembly which represents a significant advancement over prior art.

The coaxial cable of the present invention can be produced by an automated process to eliminate manual application of the elastomeric material to both speed up the manufacturing process and allow for greater control and repeatability in the construction of the cable. The elastomeric material 12 is preferrably applied to the metallic shield 10 with a pressure of between 5 and 10 pounds per square inch to provide a substantially void-free interface of the primary insulation material 8 and the metallic shield 10.

Although the invention has been described with reference to a particular embodiment thereof, it will be understood to those skilled in the art that the invention is capable of a variety of alternative embodiments within the spirit and scope of the appended claims.

What is claimed is:

1. A high voltage coaxial cable comprising:

a center conductor;

a layer of semiconductor material surrounding said center conductor;

a primary insulation material surrounding said semiconductor material;

a braided metallic shield surrounding said primary insulation material; and a room temperature-curable silicone elastomeric material applied to said braided metallic shield and filling the voids at the interface of said primary insulation material and said braided metallic shield.

2. A high voltage coaxial cable as defined in claim 1 wherein said layer of semiconductor material comprises a tape wound about said center conductor and having particles of semiconductor material embedded therein.

3. A high voltage coaxial cable as defined in claim 1 wherein said layer of semiconductor material is a carbon-containing polymeric material extruded on the surface of said center conductor.

4. A high voltage coaxial cable as defined in claim 3 wherein said primary insulation material is extruded on the surface of said layer of semiconductor material.

5. A high voltage caoxial cable as defined in claim 4 wherein said center conductor comprises a plurality of electrical conductor strands.

6. A method of forming a high voltage coaxial cable comprising the steps of:

(a) forming a layer of a semiconductor material over a center conductor;

(b) forming a primary insulation material over said semiconductor material;

(c) braiding a metallic shield over said primary insulation material; and (d) applying a room temperature-curable silicone elastomeric material to said metallic shield with a sufficient pressure to provide a substantially void-free interface of said primary insulation material and said metallic shield.

7. A method in accordance with claim 5 wherein said pressure is between 5 and 10 pounds per square inch.

8. A method in accordance with claim 7 wherein in step (a) said semiconductor material is extruded over the surface of said center conductor and in step (b) said primary insulation material is extruded over the surface of said semiconductor material.

* * * * *

UNITED STATES PATENT AND TRADEMARK OFFICE

CERTIFICATE OF CORRECTION

PATENT NO. : 4,584,431

DATED : April 22, 1986

INVENTOR(S) : Robert J. Tippie et al.

It is certified that error appears in the above-identified patent and that said Letters Patent is hereby corrected as shown below:

On the title page insert

--(73) Assignee: The United States of America as represented by the Secretary of the Air Force, Washington, D.C. --.

Signed and Sealed this

*Twenty-ninth* Day of *July 1986*

[SEAL]

*Attest:*

DONALD J. QUIGG

*Attesting Officer*

*Commissioner of Patents and Trademarks*